United States Patent [19]

Punte

[11] 4,270,555

[45] Jun. 2, 1981

[54] MULTI-STAGE HAIR CURLER

[76] Inventor: Mildred C. Punte, 9028 Hines Rd., Baltimore, Md. 21234

[21] Appl. No.: 140,489

[22] Filed: Apr. 15, 1980

[51] Int. Cl.[3] ..... A45D 2/00

[52] U.S. Cl. ..... 132/40

[58] Field of Search ..... 132/40, 42, 38

[56] References Cited

U.S. PATENT DOCUMENTS

| | | | |
|---|---|---|---|
| 1,652,356 | 12/1927 | Hammerly | 132/38 |
| 3,241,561 | 3/1966 | Richmond | 132/40 |
| 3,289,680 | 12/1966 | Kubiak | 132/40 |

*Primary Examiner*—G. E. McNeill

*Attorney, Agent, or Firm*—Walter G. Finch

[57] ABSTRACT

An improved hair curler that provides for a plurality of stages of hair curling with increasing wave lengths along the length of the hairs of the head. The improved hair curler may be used on short hair or very long hair. The multi-stages provide for a selectivity of lengths for short hair. The improved curler consists of a plurality of removably insertable curler components that nest one within the other in a manner similar to a telescoping mechanism. An elastic tie provides a means for securing the plurality of removably insertable components together and, at the same time, holds the hair in place on the curler. A port hole in one end provides a means for applying wave solution to the hair rolled on the interior of the roller, with communicating slots to permit the solution to seep through to the hair at the periphery of the spiraling rolls of hair.

10 Claims, 9 Drawing Figures

MULTI-STAGE HAIR CURLER

BACKGROUND AND SUMMARY OF THE INVENTION

The invention relates to hair styling or coiffure forming devices and in particular to hair curlers. Specifically, the invention relates to spool-type curlers, but in this case to a plurality of stages of hair curlers that nest one within the other, and having means for introducing a wave solution to the curled hair from the inside of the curl to the outside while on the curler.

Hair curlers of the spool-type are in general use, with numerous means for securing the hair to the curler. The most common types come in a plurality of lengths and sizes, all of which each make only one type or style of wave, either a very tight wave, or a loose-type wave. The present invention overcomes these drawbacks.

When the small diameter spools are used there is a resulting kinky wave over the entire coiffure, and on long hair only the end has a wave with the major portion of the hair straight and no wave. When large diameter spools are used the ends of long hair are loose and without any curl. As a result, in order to obtain a satisfactory combination of end curl and a wave in the balance of the hair requires considerable effort that is time consuming.

The hair curler of U.S. Pat. No. 3,080,873, which was invented by one of the present coinventors, was an improvement over the prior art in that it provided for curls at the ends of the hair and simultaneously provided a wave adjacent to the curled ends. This curler, however, had two drawbacks, it was not suitable for providing a wave in long hair and there was no way of introducing wave solution to the interior of the rolled hair on the curler.

In the present invention, a plurality of successive rollers that telescope over each succeeding roller are used to provide a wave to long hair. A port hole in one end of the innermost roller provides a means for introducing a wave solution to the innermost rolls of hair around the roller. Communicating slots in the other rollers permits the wave solution to penetrate outwardly through the succeeding rolls of hair.

"End papers", or "end wrappers" which are normally lapped across the ends of the hair before rolling the hair on the rollers, are used in a different manner in the present invention that facilitates the rolling of the hair in the roller and makes the operation easier. It is also to be noted that "end gauze" may be used as the "end wrapper" with the present invention.

The present invention may be used for styling the hair in a permanent wave process or for styling the hair in a hair setting process.

It is, therefore, an object of the invention to provide a hair curler that will provide a plurality of different wave lengths in the curled hair of a coiffure.

It is also an object of the invention to provide a hair curler that is capable of providing a wave for long hair.

It is another object of the invention to provide a hair curler that facilitates introducing a wave solution to the interior rolls of hair on the roller.

It is still another object of the invention to provide a hair curler that facilitates the seepage of a wave solution throughout the successive rolls of hair on the roller.

It is also another object of the invention to provide a hair curler that facilitates an improved method of using end wrappers on hair during a hair styling process.

DESCRIPTION OF THE PREFERRED EMBODIMENTS

Figure 6:
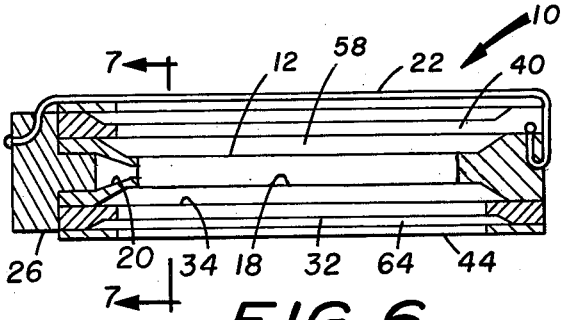
FIG. 6 is a longitudinal section, with some components shown in side view, of a multi-stage hair curler.
Figure 7:
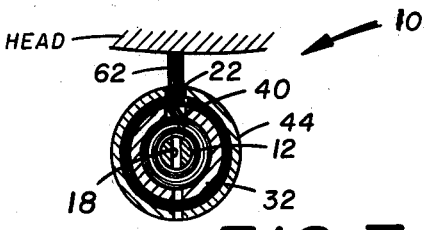
FIG. 7 is a cross-sectional view on line 7—7 of FIG. 6, showning hair undergoing treatment in a multi-stage hair curler.

Referring to the drawings and particularly, to FIGS. 6 and 7, a multi-stage hair curler device is shown at 10. A description of the multi-stage hair curler 10 is provided hereinafter.

Figure 3:
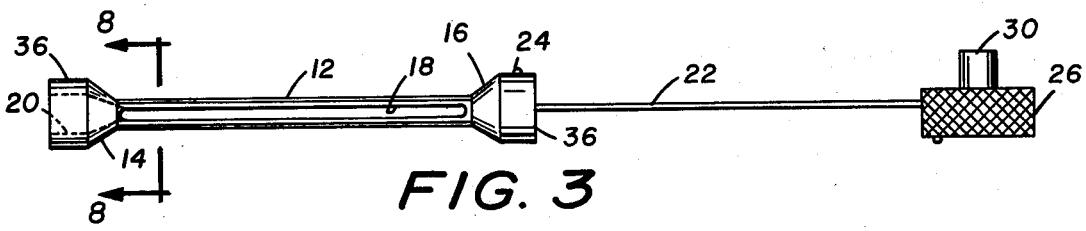
FIG. 3 is a side view of a spindle for a multistage hair curler.

Referring now to FIGS. 3 and 6, the first stage of the multi-stage hair curler 10 is shown as a cylindrical-like and rod-like elongated spindle 12. The spindle 12 has tapered ends 14 and 16 which extend in opposite directions. The spindle has a longitudinal slot 18 extending through it. A port hole 20 extends axially through the tapered end 14 and communicates between the exterior of the spindle 12 and the interior of the slot 18.

A string-like elastic band or cord 22 is detachably secured 24 to the tapered end 16. At the distal end of the elastic cord 22 is a detachable plug 26 affixed to the elastic cord 22. The plug 26 has a top 28 for grasping with the fingers, the top 28 may be knurled as shown in the drawing, and a stud-like end 30. The stud-like end 30 is a mating fit in the port hole 20, the length of the stud-like end 30 being sufficient to hold securely under the tension pull of the elastic cord 22.

It is through the port hole 20 that a wave solution or wave lotion is introduced to pass into the slot 18 and thereby into the hair wrapped around the spindle 12 as hereinafter described. The wave solution may be introduced into the port hole 20 by a squeeze bottle with tapered tip or by other means. The plug 26, when in place in the port hole 20, prevents the wave solution from running out, although the plug 26 in conjunction with the elastic cord 22 has second function as described hereinafter.

The aforementioned spindle 12 serves as the first stage for curling the hair which will be described hereinafter. The second or intermediate stage of curling is provided by the intermediate roller 32 shown in FIG. 4 and shown assembled in the multi-stage hair curler 10 in FIGS. 6 and 7.

The intermediate roller 32 is a hollow cylindrical spool that is tube-like and having an inside longitudinal passageway 34 therethrough. The inside diameter of passageway 34 is a mating fit for the outside diameter 36 of tapered ends 14 and 16 so that the spindle 12 may be slidably and removably inserted into the passageway 34 in intermediate roller 32.

The exterior of intermediate roller 32 is undercut 52 to provide a smaller outside diameter over most of the length of the roller 32, comparable to the configuration of spindle 12 as formed by the tapered ends 14 and 16.

Figure 9:
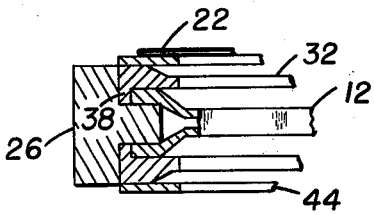
FIG. 9 is a partial cross-sectional view of a second embodiment of FIG. 6.

A second embodiment of intermediate roller 32 has one end of said passageway 34 partially closed by an end wall 38 as shown in FIG. 9. The end wall 38 has a communicating port hole (not numbered) centrally located therein and communicating between the exterior of intermediate roller 32 and port hole 20 in tapered end 14 of spindle 12. The stud end 30 of plug 26 slidably and removably connects intermediate roller 32 and spindle 12. The communicating port hole (unnumbered) in end wall 38 also serves as the means for introducing the aforementioned wave solution through the end wall 38 and thereby through the port hole 20 as hereinbefore described. When the second embodiment is used for intermediate roller 32, the overall length of spindle 12 is shorter by the thickness of end wall 38 so that the assembled spindle 12 and intermediate roller 32 are flush with each other at the open end of intermediate roller 32.

Figure 4:
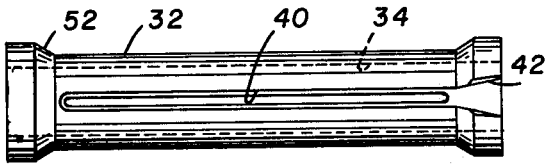
FIG. 4 is a side view of an intermediate spool of a multi-stage hair curler.

The intermediate roller 32 as shown in FIGS. 4 and 6 has a longitudinal slot 40 on one side thereof extending from a cut flare 42 at one end to a point close to the other end thereof. This longitudinal slot 40 is also in the second embodiment of intermediate roller 32 with the cut flare 42 being at the open end of passageway 34 opposite the closed end wall 38.

The intermediate roller 32 may be provided in a plurality of sizes, each next succeeding larger size slidably and removably being telescoped over the previous size. The structure of each such plurality of sizes being the same as shown in FIG. 4 and described hereinbefore. The plurality of sizes of intermediate roller 32 may also be provided in the second embodiment structure as shown in FIG. 9. The use of a plurality of sizes of intermediate roller 32 provides the means for waves in long hair.

Figure 5:
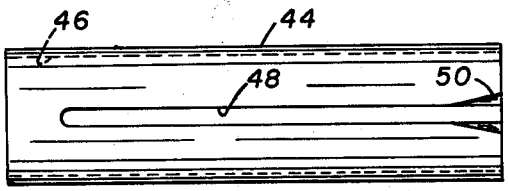
FIG. 5 is a side view of an exterior spool of a multi-stage hair curler.

Turning now to FIGS. 5 and 6, the exterior roller 44 consists of a hollow cylindrical spool having a passageway 46 therethrough and a longitudinal slot 48 similar to longitudinal slot 40. The longitudinal slot 48 has a flared end 50 similar to flared end 42. The exterior diameter of exterior roller 44 is shown in FIG. 5 without an undercut, but it is to be understood that the exterior diameter may be undercut similar to undercut 52 on intermediate roller 32. Further, it is to be understood that the exterior roller 44 may have a closed end similar to that shown for intermediate roller 32 in FIG. 9.

The inside diameter of passageway 46 is a mating for over the ends of intermediate roller 32 which are left by undercut 52. The exterior roller 44 is slidably and removably assembled in a telescoping manner over the intermediate roller 32.

It is to be understood that an exterior roller 44 may be provided for each size of intermediate roller 32 so that in the use of any plurality of intermediate rollers 32 the last such intermediate roller used may be covered by an exterior roller 44.

It is further to be understood, as hereinafter described for using the multi-stage hair curler 10, that the multi-stage hair curler 10 may be used without using the exterior roller 44 over the last used intermediate roller 32. As hereinafter described in the use of the multi-stage hair curler 10, hair may also be rolled on the exterior of the exterior of the exterior roller 44 or the exterior roller 44 may be used merely to hold the last rolled portion of hair in place on the last used intermediate roller 32.

The exterior surface of spindle 12, intermediate roller 32, and exterior roller 44, where the hair interfaces with the components may be smooth or roughened to facilitate contact with the hair.

Turning now to FIG. 7, the use of the multi-stage hair curler 10, as shown assembled in FIG. 6, is described by steps. Note in FIG. 6 how the elastic cord 22 is stretched and drawn over the outside of the last stage of multi-stage hair curler 10 components and the stud end 30 of plug 26 removably inserted in the port hole 20 to hold the assembly together. This same procedure is used when the hair is rolled on to each of the stages as hereinnow described.

Figure 8:
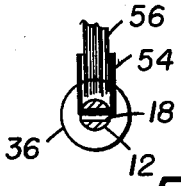
FIG. 8 is a cross-sectional view on line 8—8 of FIG. 3, showing ends of hair between surfaces of an end wrapper in a component of a multi-stage hair curler.

An end paper or end gauge 54 is slipped through slot 18 in spindle 12 as shown in FIG. 8 and turned upward in a "U" formation. The ends of the portion of hair 56 that is to be rolled on the roller spindle 12 is then inserted between the upturned or legs of the "U" of end paper or end gauge 54 and held together in this arrangement by the fingers to begin the rolling process. The use of the slot 18 in the spindle 12 for holding the end paper or end gauge 54 is an improvement in the process of rolling hair on hair curlers that is provided by the present invention. The end paper or end gauge 54 is a retention means to prevent the hair ends from kinking or getting frizzled.

With the end paper or end gauge 54 in place on the spindle 12 and around the ends of the portion of hair 56 being placed on the multi-stage hair curler 10, the hair 56 and end paper or gauge 54 is now wrapped or rolled around spindle 12 in the first stage of the process of using the multi-stage hair curler 10, as shown in FIG. 7. The hair in this process is dampened to facilitate the wrapping or rolling.

Figure 1:
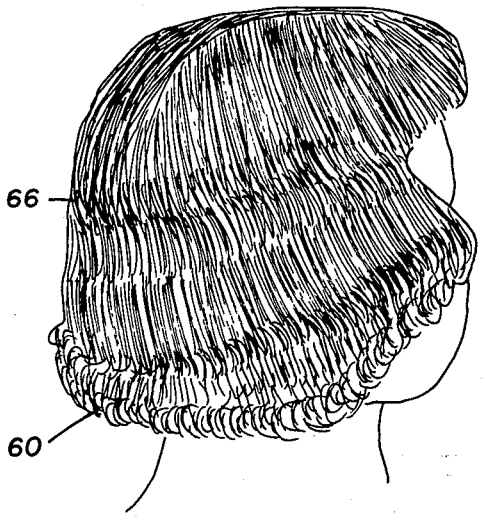
FIG. 1 is a perspective view of the head of a person illustrating waves and curls in a short hair coiffure.
Figure 2:
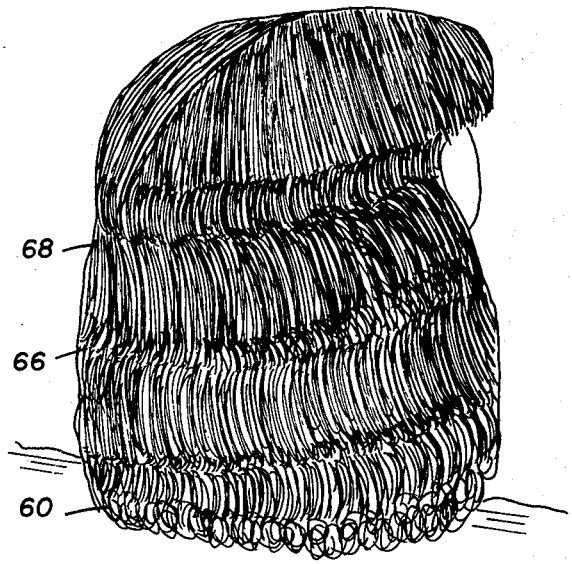
FIG. 2 is a perspective view of the head of a person illustrating waves and curls in a long hair coiffure.

The ends of the portion of hair 56 and the end paper or gauge 54 are rolled on spindle 12 to wind up a length of hair thereon within the space 58. The space 58 is in the depressed area of the spindle 12 due to the difference in diameters of the main body of spindle 12 and the end diameters 36 of the tapered ends 14 and 16. This process in the use of multi-stage hair curler 10 forms small diameter end curls 60 on the hair as shown in FIGS. 1 and 2. These end curls 60 are sometimes referred to as "tight curls".

The next step in the use of the multi-stage hair curler 10 is to use one of the intermediate rollers 32. The intermediate roller 32 is slipped over the spindle 12, with the hair 56 and end paper or gauge 54 rolled on it, by passing the hair portion 62, of the partially rolled hair, into the slot 40 of the intermediate roller 32. In this position the intermediate roller 32 holds the rolled hair 56 and end paper or gauge 54 in place during the curling treatment. The hair is next rolled around the intermediate roller 32 by revolving the assembly to wind up a length of hair thereon within the space 64. The space 64 is in the depressed area of the intermediate roller 32 that is formed by the undercut 52. This process in the use of multi-stage hair curler 10 forms an intermediate or looser wave 66 than the tight curls 60, as shown in FIGS. 1 and 2.

For short hair, as shown in FIG. 1, this may be the limit of the use of multi-stage hair curler 10. If the intermediate roller 32 is the last stage to be used the elastic cord 22 is then stretched and drawn across the hair and the stud 30 of plug 26 inserted in the port hole 20 to secure the curler to the hair.

It is also to be noted that for the very short bits of hair, such as might exist near the sides or on the neck with short hair cuts, it may require only the spindle 12 to form a tight curl 60 as the hair may be too short for a curl beyond that point. In that case, the elastic cord 22 is stretched and drawn across the hair after rolling and the stud 30 of plug 26 inserted into the port hole 20 to hold the hair in place on the spindle 12 and to secure the spindle 12 to the hair.

If longer hair is being curled or waved as shown in FIG. 2, then a plurality of intermediate rollers 32 of successively larger sizes, as hereinbefore described, are used to add additional waves up the length of the hair, each succeeding wave having a larger wave length as the diameter of the roll increases in a spiral-like configuration. As additional intermediate rollers 32 of larger size are added they in turn hold the previous rolled hair in place and then form looser waves 68. Thus, the multi-stage hair curler 10 is limited only by the space in which the assembled rollers can be arranged next to each other around the head.

Instead of using a second intermediate roller 32, an exterior roller 44 may be used. An exterior roller 44 may be used to merely hold the hair in place on the last used intermediate roller 32 or additional hair may be rolled on the exterior roller 44, the rolling process being the same as hereinbefore described for intermediate roller 32. In using the exterior roller 44, the hair from the intermediate roller 32 is passed through the slot 48, in the same manner as was described for the intermediate roller 32. Likewise the elastic cord 22 is stretched and drawn across the exterior roller 44 and secured in place the same as described for the intermediate roller 32.

Wave solution introduced through the port hole 20 seeps through and into the hair that has been rolled by passing through the slots 18, 40, and 48 as the case may be. It is to be noted that although a single slot 18, 40, and 48 is shown in the spindle, intermediate roller 40, and exterior roller 44 respectively, a plurality of such slots may be used and such a variation is within the scope and intent of the invention.

The elastic cord 22, when tensioned by stretching and drawing it across the hair or roller as hereinbefore described, holds the hair in position and prevents it from unrolling while the process is being completed.

The spindle 12, intermediate roller 32, and exterior roller 44 may be made of a plastics, aluminum, or any other light weight material.

The spindle 12, intermediate roller 32 and exterior roller 44 may be made in several lengths to handle different widths of portions of the hair.

All components of the multi-stage hair curler 10 are interchangeable so that if one component breaks the others may be reassembled with other components.

As can be readily understood from the foregoing description of the invention, the present structure can be configured on different modes to provide the ability to curl hair in a series of curls or waves.

Accordingly, the modifications and variations to which the invention is susceptible may be practiced without departing from the scope and intent of the appended claims.

What is claimed is:

1. A method for curling human hair comprising, inserting a retention means in a slotted holder so that the retention means extends approximately equally on both sides of said slotted holder, bending said retention means upward to form a "U" shaped configuration, placing the ends of a portion of said human hair between upstanding legs of said "U" shaped configuration of said retension means, rolling a length of said hair and said retension means around and upon said slotted holder, inserting the rolled hair on said slotted holder into a tube-like means to hold the rolled hair in place, the tube-like means being slotted to permit passage of the portion of the hair growing from the head, rolling an additional length of hair around said tube-like means, inserting the rolled hair on said tube-like means into a second tube-like means in a manner similar to the foregoing and thereafter rolling an additional length of hair upon said second tube-like means, and securing the rolled hair in place and maintaining the assemblage together as a unit be external means affixed at each end of said slotted holder.

2. A multi-stage hair curler device, comprising:

a first cylindrical-like member;

at least one second cylindrical-like member, said second cylindrical-like member being hollow and having a passageway therethrough, said first cylindrical-like member being slidably and removably insertable into said second cylindrical-like member;

a third cylindrical-like member, said third cylindrical-like member being hollow and having a passageway therethrough, said second cylindrical-like member, with said first cylindrical-like member therein, being slidably and removably insertable into said third cylindrical-like member; and a retaining means, said retaining means being elastic-like and being attached to one end of said first cylindrical-like member and stretchable so as to facilitate affixing the distal end thereof to the opposite end of said first cylindrical-like member to hold assemblage of first, second, and third cylindrical-like members together as a unit.

3. The multi-stage hair curler device as recited in claim 2, wherein said first cylindrical-like member consists of a centrally located solid cylindrical body portion, said body portion having a longitudinal slot therein and transversely therethrough, and enlarged tapered ends integrally formed and connected to said body portion, one said tapered end having a port hole therein, said port hole being axially aligned with said cylindrical body portion, said port hole communicating between the exterior of said first cylindrical-like member and the interior of said longitudinal slot.

4. The multi-stage hair curler device as recited in claim 3, wherein said second cylindrical-like member has a longitudinally extending slot provided therein and radially located with respect to said passageway extending therethrough, said slot extending from one end thereof and terminating short of the other end thereof for allowing intermediate portions of the hair to be passed therethrough to the outer surface of said cylindrical-like member.

5. The multi-stage hair curler device as recited in claim 4, wherein said body portion of said first cylindrical-like member is spaced from the interior surface of said passageway through said second cylindrical-like member to form an annulus between said first cylindrical-like member and the interior of said second cylindrical-like member when said first and second cylindrical-like members are co-axially positioned and co-extensive with each other.

6. The multi-stage hair curler device as recited in claim 4, wherein said third cylindrical-like member has a longitudinally extending slot provided therein and radially located with respect to said passageway extending therethrough, said slot extending from one end thereof and terminating short of the other end thereof for allowing intermediate portions of the hair to be passed therethrough to the outer surface of said cylindrical-like member.

7. The multi-stage hair curler device as recited in claim 3, wherein said retaining means is detachable from said end of said first cylindrical-like member and additionally a plug-like means detachably affixed to said distal end of said retaining means, said plug-like means being configured to be removably affixed into said port hole.

8. The multi-stage hair curler device as recited in claim 6 and additionally at least one other second cylindrical-like member, any such additional second cylindrical-like member being larger sized so as to be slidably and removably telescoped over the preceding second cylindrical-like member, said third cylindrical-like member being larger sized so as to be slidably and removably telescoped over the last used second cylindrical-like member.

9. The multi-stage hair curler device as recited in claim 6, wherein one end of said passageway in said second cylindrical-like member is closed, said closed end having a centrally located aperture therein, said aperture being so axially aligned so as to communicate with said port hole in said first cylindrical-like member.

10. The multi-stage hair curler device as recited in claim 9, wherein one end of said passageway in said third cylindrical-like member is closed, said closed end having a centrally located aperture therein, said aperture being so axially aligned so as to communicate with said aperture in said second cylindrical-like member and said port hole in said first cylindrical member.

* * * * *